US005712919A

United States Patent [19]

Ruhling

[11] Patent Number: 5,712,919

[45] Date of Patent: Jan. 27, 1998

[54] HEARING AID APPARATUS POWERED BY CAPACITOR

[75] Inventor: Dale M. Ruhling, Vanderbilt, Mich.

[73] Assignee: Multi-Line Designs, Inc., Mecosta, Mich.

[21] Appl. No.: 479,575

[22] Filed: Jun. 7, 1995

Related U.S. Application Data

[63] Continuation of Ser. No. 228,438, Apr. 15, 1994.

[51] Int. Cl.[6] ..... H04R 25/00

[52] U.S. Cl. ..... 381/69.2

[58] Field of Search ..... 381/68, 68.6, 69.2, 381/69; 607/5, 7, 67

[56] References Cited

U.S. PATENT DOCUMENTS

| | | | |
|---|---|---|---|
| 2,197,314 | 4/1940 | Olson | 381/69.2 |
| 3,354,271 | 11/1967 | McDermaid | 381/69.2 |
| 4,272,591 | 6/1981 | Brander | 429/98 |
| 4,736,583 | 4/1988 | Hudema et al. | 60/256 |
| 5,111,506 | 5/1992 | Charpentier et al. | 381/68.4 |
| 5,591,217 | 1/1997 | Barreras | 607/61 |

*Primary Examiner*—Curtis Kuntz
*Assistant Examiner*—Rexford N. Barnie
*Attorney, Agent, or Firm*—Flynn, Thiel, Boutell & Tanis, P.C.

[57] ABSTRACT

A self-contained hearing aid has a housing which contains a microphone, a miniature speaker, an amplifier which amplifies signals from the microphone and supplies them to the speaker, and a capacitor which serves as the sole source of power for the amplifier during normal operation of the hearing aid. An arrangement for recharging the capacitor may include a pair of charging terminals within the hearing aid, and a recharging unit that is separate from the hearing aid and has a case with two probes which are coupled to a battery in the case and which can each engage a respective charging terminal. An alternative charging arrangement includes within the hearing aid a coil and a rectifier circuit coupling the coil to the capacitor, and includes a recharging unit which is separate from the hearing aid and has a further coil driven by an AC signal.

19 Claims, 3 Drawing Sheets

FIG. 1

HEARING AID APPARATUS POWERED BY CAPACITOR

This application is a continuation of U.S. Ser. No. 08/228 438, filed Apr. 15, 1994.

FIELD OF THE INVENTION

The present invention relates generally to a self-contained hearing aid and, more particularly, to an improved power source and recharging arrangement for a self-contained hearing aid.

BACKGROUND OF THE INVENTION

For those who have a hearing impairment, conventional battery-powered hearing aids have been a blessing, because they permit the person to hear accurately while moving freely about. This is particularly true of the miniature hearing aids commonly referred to as in-the-ear models. Nevertheless, although these conventional hearing aids have been generally adequate for their intended purposes, they have not been satisfactory in all respects.

In particular, because they are usually operated continuously during the waking hours of the user, the batteries in them must be either recharged or replaced on a frequent basis. In the case of replaceable batteries, this involves the expense and hassle of purchasing and maintaining a supply of replacement batteries, the need to remember to make the necessary replacement on a regular basis, and the ecological implications associated with disposal of the used batteries. With respect to rechargeable batteries, there is the occasional expense of replacing the rechargeable battery, as well as the more frequent need to remember to recharge the battery currently in the unit.

One known hearing aid with a rechargeable battery also has an internal coil and a rectifier coupling the coil to the battery, and a physically separate recharging unit is provided to generate an AC magnetic field that causes the coil in the hearing aid to produce an AC signal which the rectifier converts to a DC signal to recharge the battery. The user usually places the hearing aid on the recharging unit when the user goes to bed so that the hearing aid is recharged while the user sleeps, and the user replaces the hearing aid in his or her ear upon arising.

One object of the present invention is to provide an improved hearing aid which does not use any form of replaceable or rechargeable battery, and in particular which has a power source that can be recharged and never needs replacing.

A further object of the invention is to provide such a hearing aid in which the power source can be charged more rapidly than in known hearing aids, and preferably can be recharged almost instantaneously.

Yet a further object is to provide such a hearing aid which can be recharged easily and conveniently from conventional batteries of the type commonly used in flashlights or radios, in a manner providing a lower effective cost than the conventional approach of using the relatively expensive replaceable batteries designed and sold specifically for hearing aids.

Still another object of the invention is to provide a recharging unit which holds the battery and is separate from the hearing aid, and which facilitates recharging of the power source in the hearing aid from the battery.

SUMMARY OF THE INVENTION

The objects and purposes of the invention, including those set forth above, are met according to one form of the present invention by providing a hearing aid which includes: a sound pickup arrangement responsive to sounds external to the hearing aid for generating an electrical signal representative of the sounds; a circuit arrangement for amplifying the electrical signal; a sound emitting arrangement responsive to the amplified electrical signal from the circuit arrangement for emitting audible sound to the exterior of the hearing aid which corresponds to the electrical signal; and a capacitor coupled to the circuit arrangement and serving as a primary source of power for the circuit arrangement during normal operation of the hearing aid.

A different form of the present invention involves the provision of: a hearing aid which includes a sound pickup arrangement responsive to sounds external to the hearing aid for generating an electrical signal representative of the sounds, a circuit arrangement for amplifying the electrical signal, a sound emitting arrangement responsive to the electrical signal amplified by the circuit arrangement for emitting externally of the hearing aid audible sound which corresponds to the electrical signal, and a capacitor coupled to the circuit arrangement and serving as a primary source of power for the circuit arrangement during normal operation of the hearing aid; and a recharging arrangement for facilitating periodic recharging of the capacitor, the recharging arrangement including a recharging unit physically separate from the hearing aid.

BRIEF DESCRIPTION OF THE DRAWINGS

Preferred embodiments of the present invention are described in detail hereinafter with reference to the accompanying drawings, in which.

DETAILED DESCRIPTION

Figure 1:
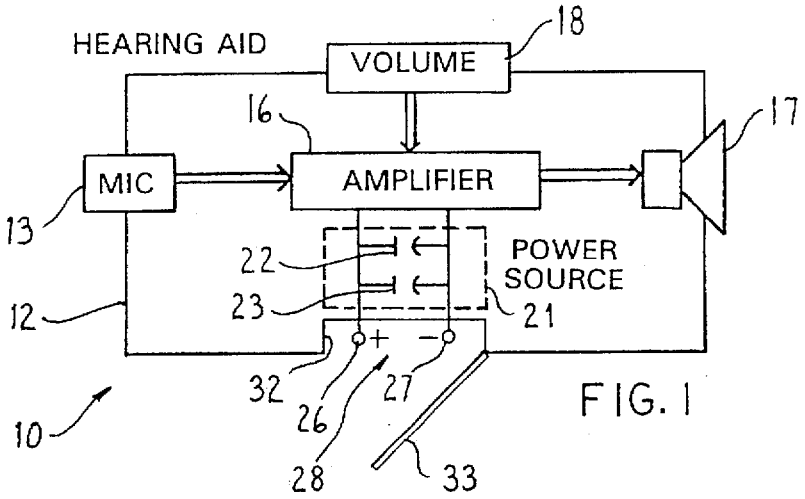
FIG. 1 is a diagrammatic view of a hearing aid embodying the present invention.

FIG. 1 is a block diagram of a hearing aid 10, which in the preferred embodiment is a self-contained unit of the in-the-ear type. The hearing aid 10 includes a plastic housing 12, a miniature microphone 13 which is supported on the housing 12 and generates an output signal representative of sounds external to the housing 12, a miniature speaker supported on the housing, and an amplifier circuit 16 which is disposed within the housing, which amplifies the electrical output signal from the microphone 13, and which uses the amplified signal to drive the miniature speaker 17. The circuit 16, in addition to amplifying the electrical signal from the microphone 13, may also perform functions such as filtering of the signal in order to eliminate signal components outside the normal audible frequency range, or attenuation of signal components in one audible frequency range relative to signal components in another audible frequency range. A manually operable volume control 18 is also provided on the housing 12, and can be used to vary the gain of the amplifier circuit 16.

Also disposed within the housing 12 is a power source 21, which includes two capacitors 22 and 23 connected in parallel with each other and having respective ends connected to respective input terminals of the amplifier circuit 16. The hearing aid 10 of FIG. 1 contains no batteries. During normal operation, the amplifier circuit 16 has as its sole and primary power source the capacitors 22 and 23, and in particular operates from an electrical charge stored on the capacitors 22 and 23. Although FIG. 2 shows two capacitors, it will be recognized that there could be only one capacitor or that there could be two or more capacitors, the number of capacitors and their capacitance determining how long the amplifier circuit 16 can be operated from the power source 21 before the power source 21 becomes discharged.

Also supported on the housing 12, preferably within a recess 28, are a pair of charging terminals 26 and 27, which are each connected to a respective end of capacitor 23. When operation of the amplifier circuit 16 has effectively discharged the capacitors 22 and 23, the capacitors 22 and 23 can be recharged by bringing respective terminals of a conventional battery into contact with the respective charging terminals 26 and 27. A feature of the present invention is that the capacitors 22 and 23 become recharged by the battery almost instantaneously, and thus the hearing aid 10 is almost immediately ready for further use by the user, without any need for the user to wait several hours while a rechargeable internal battery is recharged.

Figure 2:
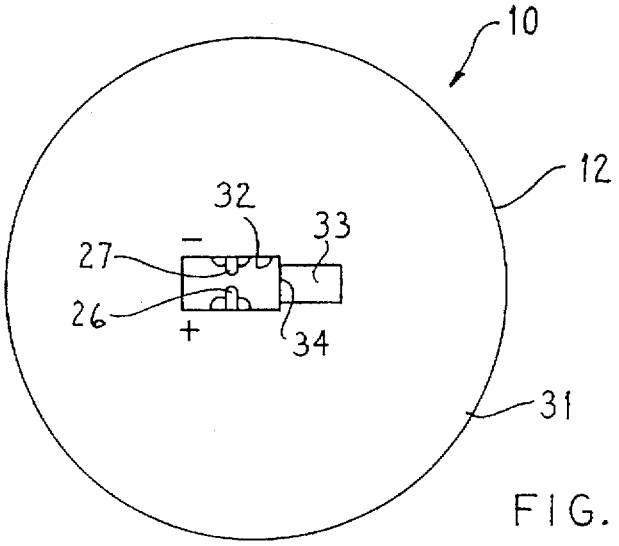
FIG. 2 is a diagrammatic exterior view of the hearing aid of FIG. 1.

FIG. 2 is a diagrammatic view of the exterior of the hearing aid 10, showing that the housing 12 has a back plate 31 with a rectangular opening 32 that can be closed by a small door or hatch 33 hingedly coupled at 34 to the back plate 31. The opening 32 provides access to the recess 28 and the charging terminals 26 and 27 therein when the hatch 33 is open. Conventional hearing aids sometimes have an opening and door similar to those shown at 32 and 33, but for the purpose of removing and replacing batteries. Since, as mentioned above, the hearing aid 10 does not have internal batteries, the opening 32 in FIGS. 1 and 2 is provided for purposes of obtaining access to the charging terminals 26 and 27 in order to effect recharging of the capacitors 22 and 23.

Figure 3:
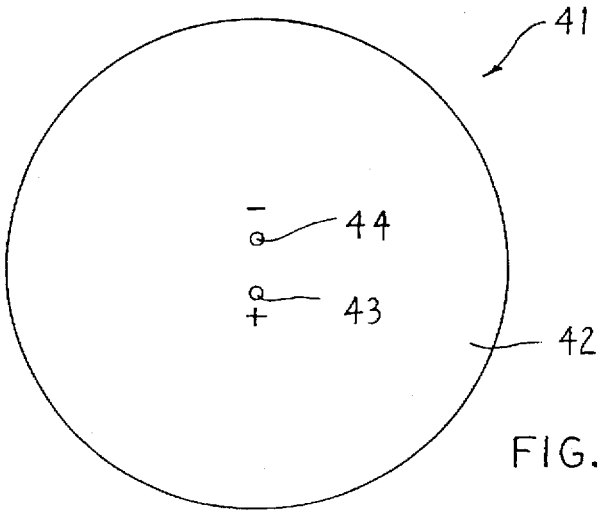
FIG. 3 is a view similar to FIG. 2 of an alternative embodiment of the hearing aid of FIG. 1.

FIG. 3 is a view which is similar to FIG. 2 and which shows a hearing aid 41 that is a variation of the hearing aid 10 of FIGS. 1 and 2. The hearing aid 41 is identical to the hearing aid 10 except that, instead of the opening and door shown at 32 and 33 in FIG. 2, the back plate 42 of the hearing aid 41 has two spaced holes 43 and 44 through it. The terminals 26 and 27 are not visible in FIG. 3, but are each disposed immediately adjacent the inner end of a respective one of the holes 43 and 44.

Figure 4:
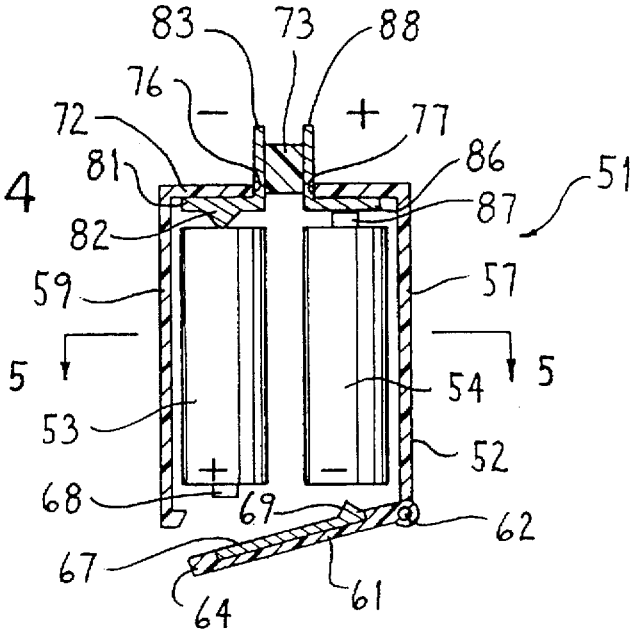
FIG. 4 is a sectional side view of a recharging unit for the hearing aids of FIGS. 1–3.
Figure 5:
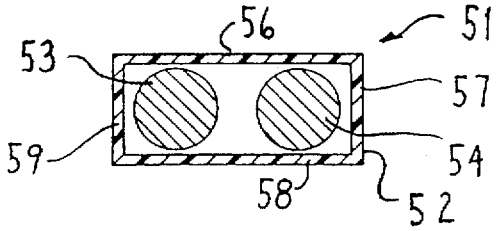
FIG. 5 is a sectional view taken along the line 5—5 in FIG. 4.

FIGS. 4 and 5 are sectional views showing a recharging unit that can be used to recharge the capacitors in the hearing aid 10 of FIGS. 1 and 2, or the capacitors in the hearing aid 41 of FIG. 3. The recharging unit 51 includes a plastic case 52 of approximately rectangular shape, the case having therein two conventional cylindrical 1.5 volt batteries 53 and 54, such as batteries of the type commonly identified as size AA, size AAA, size C or size D. The case 52 has four sidewalls 56–59, and a lid 61 that serves as a bottom wall is pivotally coupled to the sidewall 57 at the lower end thereof by a hinge arrangement 62. A detent arrangement 63 and 64 provided at the outer end of lid 61 and the lower end of sidewall 59 is capable of releasably holding the lid 61 in a closed position. The lid 61 has secured to its inner side a metal strip 67, one end of which can engage a positive terminal 68 of battery 53 when the lid 61 is in its closed position. The other end of the strip 67 has a projection 69 engageable with the negative end of battery 54.

The case 52 has a top wall 72 integral with and extending between the upper ends of sidewalls 56–59. The top wall 72 has an upward projection 73 in the center thereof, and has two circular holes 76 and 77 extending vertically therethrough adjacent the projection 73 on opposite sides thereof. Another metal strip 81 is fixedly secured to the inner side of top wall 72, has a downward projection 82 engageable with the negative end of battery 53, and has an upperwardly extending wire-like charging probe 83, the probe 83 extending upwardly through the hole 76 to a location which is a small distance above the upper end of projection 73. A further metal strip 86 is fixedly secured to the inner side of wall 72 so as to be engaged by the positive terminal 87 of battery 54, and has a wire-like charging probe 88 that extends upwardly through the hole 77 to a location spaced a small distance above the upper end of projection 73.

With the batteries 53 and 54 disposed within case 52 and the lid 61 in a closed position, the probes 88 and 83 can be inserted through the opening 32 (FIGS. 1 and 2) and into the recess in the hearing aid 10 so as to each electrically contact a respective one of the charging terminals 26 and 27, so that capacitors 22 and 23 are almost instantaneously charged by the batteries 53 and 54. With respect to the hearing aid 41 of FIG. 3, the probes 88 and 83 of the recharging unit 51 have the same spacing as and would be inserted through the holes 43 and 44, in order to contact the charging terminals of the hearing aid 41 for purposes of charging the capacitors in that hearing aid.

Figure 6:
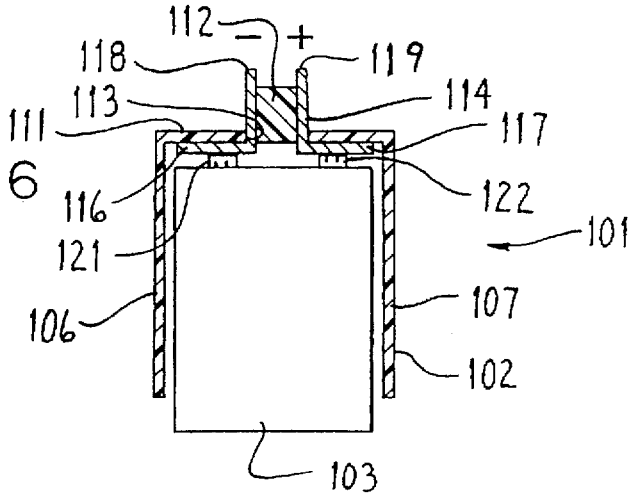
FIG. 6 is a sectional side view of an alternative embodiment of the recharging unit of FIG. 4.

FIG. 6 is a sectional side view of a recharging unit 101 which is an alternative embodiment of the unit 51 of FIGS. 4 and 5. The unit 101 includes a plastic case 102 for a conventional 9 VDC battery 103. The case 102 has four sidewalls, two of which are visible at 106 and 107 in FIG. 6. The case 102 does not have a bottom wall, but does have a top wall 111 integral with and extending between the upper ends of the four sidewalls. The top wall 111 has an upward projection 112 in its center, and has circular holes 113 and 114 extending vertically through it on opposite sides of the projection 112. Two metal strips 116 and 117 are fixedly mounted at spaced locations on the inner side of the top wall 111, and each have a respective charging probe 118 or 119 extending upwardly through a respective hole 113 or 114 to a location spaced slightly above the upper end of projection 112. Cooperating clasp arrangements 121 and 122 of a conventional type each include a first part which is a positive or negative terminal of the battery 103, and a complementary second part which is fixedly mounted on a respective strip 116 or 117. The recharging unit 101 is used to recharge the hearing aids 10 and 41 of FIGS. 1–3 in substantially the same manner as the recharging unit 51 (FIGS. 4–5).

Figure 7:
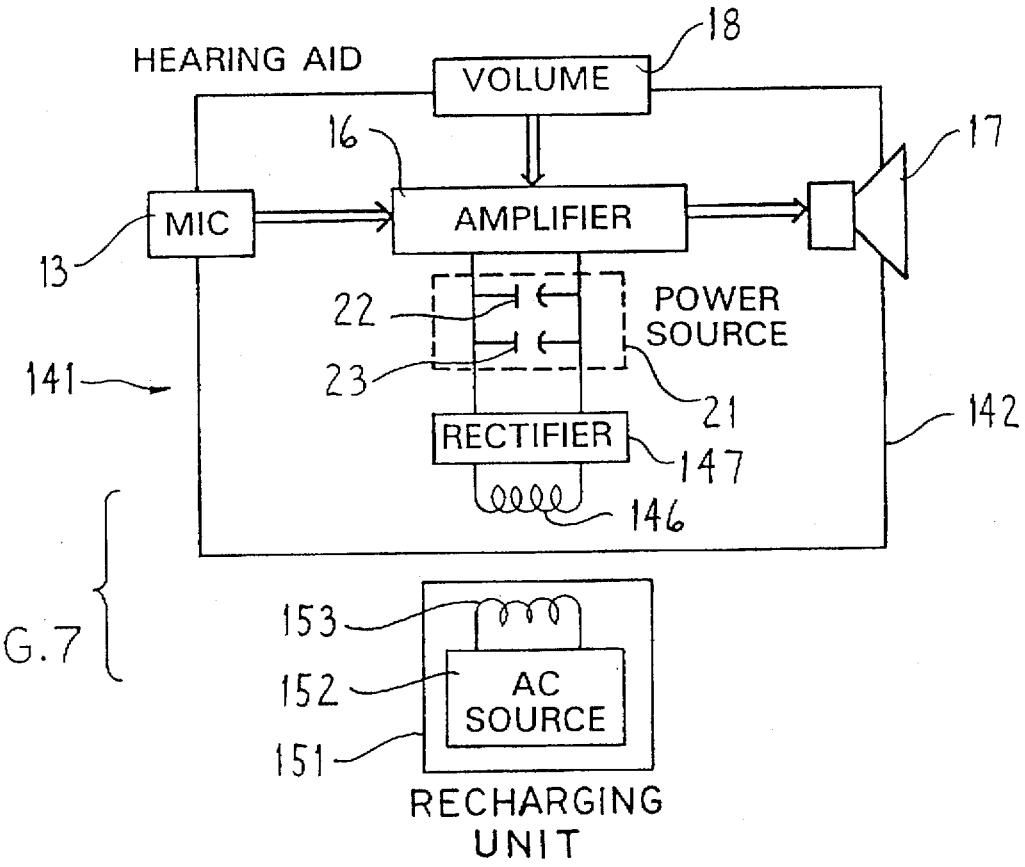
FIG. 7 is a block diagram of a further embodiment of a hearing aid and a recharging unit.

FIG. 7 shows a hearing aid 141 which is a further alternative embodiment of the hearing aid 10 of FIG. 1, and which includes a plastic housing 142. Components of the hearing aid 141 which are identical to corresponding components of the hearing aid 10 are identified with the same reference numerals, including a miniature microphone 13, an amplifier circuit 16, a miniature speaker 17, a manual volume control 18, and a power source 21 that includes capacitors 22 and 23. The basic difference between the hearing aid 141 of FIG. 7 and the hearing aid 10 of FIG. 1 is that the externally accessible charging terminals 26 and 27 of the hearing aid 10 are not present in the hearing aid 141. Instead, a coil 146 is coupled to input terminals of a rectifier circuit 147, which in turn has outputs coupled to respective ends of the capacitor 23.

A recharging unit 151, which is not part of the hearing aid 141 and which is not present during normal operation of the hearing aid 141, includes an AC source 152 which drives a coil 153 in order to produce an AC electromagnetic field in the region of recharging unit 151. When the hearing aid 141 is physically close to the recharging unit 151, the AC electromagnetic field induces a flow of AC current in the coil 146, which is rectified by the rectifier circuit 147 in a conventional manner in order to produce a DC signal that charges the capacitors 22 and 23. During normal operational use, the hearing aid 141 is in the ear of the user and is nowhere near the recharging unit 151, as a result of which the coil 146 and rectifier circuit 147 are effectively inactive. Thus power source 21 serves as the sole or primary circuit power for amplifier circuit 16 during normal operation, the amplifier circuit 16 operating totally from the charge stored on capacitors 22 and 23. When the capacitors 22 and 23 need recharging, the hearing aid 141 is removed from the ear of the user and is placed in close proximity to the recharging unit 151, so that the electromagnetic field from coil 153 causes the coil 146 and rectifier circuit 147 to charge capacitors 22 and 23. The recharging unit 151 preferably is a unit which sits on a bedside table of the user and has a line cord connected to a standard 120 VAC wall outlet to provide power to the AC source 152. The user places the hearing aid 141 on the recharging unit 151 when the user retires at night, so that the capacitors 22 and 23 are charged during the night, and then the user replaces the hearing aid 141 in his or her ear the following morning. In the embodiment of FIG. 7, the recharging unit 151 does not charge the capacitors 22 and 23 instantaneously, but the period of time required to charge the capacitors 22 and 23 is substantially less than the period of time required with a conventional hearing aid to recharge one or more rechargeable internal batteries.

Although particular preferred embodiments of the invention have been disclosed in detail for illustrative purposes, it will be recognized that variations or modifications of these embodiments, including the rearrangement of parts, lie within the scope of the present invention.

The embodiments of the invention in which an exclusive property or privilege is claimed are defined as follows:

1. A hearing aid assembly adapted to be worn on the human body, comprising: a hearing aid unit which includes a sound pickup means responsive to sounds external to said hearing aid unit for generating an electrical signal representative of said sounds, an amplifying circuit for amplifying said electrical signal, sound emitting means responsive to said electrical signal amplified by said amplifying circuit for emitting externally of said hearing aid unit audible sound which corresponds to said electrical signal, and a capacitor coupled to said amplifying circuit and serving as the only source of power for said amplifying circuit during normal operation of said hearing aid unit; and a recharging unit physically separate from said hearing aid unit for periodically recharging said capacitor.

2. The hearing aid assembly according to claim 1, wherein said hearing aid unit has first and second recharging terminals which are each electrically coupled to a respective end of said capacitor and said recharging unit has positive and negative terminals which are each releasably electrically coupled to a respective one of said first and second recharging terminals during recharging of said capacitor.

3. The hearing aid assembly according to claim 2, wherein said recharging unit includes a case having a battery therein, said case including first and second electrically conductive probe portions which are each engageable with a respective one of said first and second recharging terminals and which are each electrically coupled to a respective terminal of said battery.

4. The hearing aid assembly according to claim 3, wherein said hearing aid unit is a self-contained unit having a housing, wherein said sound pickup means is provided on said housing and is responsive to sounds outside said housing, wherein said sound emitting means is provided on said housing and emits said audible sound to the exterior of said housing, and wherein said amplifying circuit said capacitor and said first and second recharging terminals are disposed within said housing, said housing having means facilitating access to said recharging terminals therein by said probe portions on said recharging unit.

5. The hearing aid assembly of claim 4, wherein said means facilitating access includes an opening in said housing and a member movable between positions respectively permitting and obstructing access to said first and second recharging terminals through said opening.

6. The hearing aid assembly according to claim 4, wherein said means facilitating access includes first and second holes through said housing and includes said recharging terminals each being disposed within said housing adjacent a respective said hole, said probe portions of said recharging unit being insertable through said holes in said housing for engagement with said recharging terminals.

7. The hearing aid assembly according to claim 3, wherein said case of said recharging unit includes sidewalls and a top wall extending between said sidewalls, said top wall having an upward projection in a center thereof and having holes therethrough on opposite sides of said projection, each of said probe portions extending through a respective said hole in said top wall, said top wall having on an inner side thereof first and second battery contact strips which are each electrically coupled to a respective said probe portion.

8. The hearing aid assembly according to claim 7, including clasp means integral with said case of said recharging unit for electrically and releasably mechanically coupling said battery to each of said strips, said clasp means including two first parts which are each fixedly mounted on a respective said strip and two second parts which each releasably engage a respective said first part and which are each a respective terminal of said battery.

9. The hearing aid assembly according to claim 7, wherein said battery of said recharging unit includes first and second cylindrical battery units which are disposed within said case of said recharging unit and which each have terminals at respective ends thereof, and wherein said case includes a lid pivotally supported on a sidewall thereof at an end remote from said top wall, said lid being movable between open and closed positions and having on an inner side thereof a metal element, said case including means for releasably holding said lid in said closed position, said battery units each having a terminal at one end thereof engaging said metal element on said lid when said lid is in said closed position and having a terminal at an opposite end thereof engaging a respective said strip on said top wall.

10. The hearing aid assembly according to claim 1, wherein said hearing aid unit includes a housing, wherein said sound pickup means is provided on said housing and is responsive to sounds outside said housing, wherein said sound emitting means is provided on said housing and emits said audible sound to the exterior of said housing, wherein said amplifying circuit and said capacitor are disposed within said housing, wherein said recharging unit further includes within said housing a first coil and a rectifier circuit coupling said first coil to said capacitor, and wherein said recharging unit physically separate from said hearing aid unit housing has therein a second coil and means for applying an AC signal to said second coil so that said second coil generates an AC electromagnetic field, wherein when said hearing aid unit is in close proximity to said recharging unit, said AC electromagnetic field induces in said first coil in said housing an AC signal which causes said rectifier circuit to supply to said capacitor a DC signal that charges said capacitor.

11. A hearing aid adapted to be carried on the human body, comprising:

a housing;

an audio transducer mounted to said housing, said audio transducer being configured to monitor sound and to produce an input signal representative of the monitored sound;

an amplifier disposed in said housing and connected to said audio transducer for receiving said input signal, said amplifier being configured to amplify said input signal to produce an amplified output signal;

at least one capacitor disposed in said housing and coupled to said amplifier for providing an energization voltage to said amplifier, said at least one capacitor being the sole source of energization power for said amplifier; and a speaker mounted to said housing and connected to said amplifier for receiving said output signal, said speaker being configured to generate audible sound in response to receipt of said output signal.

12. The hearing aid according to claim 11, including first and second charging terminals each electrically coupled to opposed ends of said at least one capacitor.

13. The hearing aid according to claim 12, wherein said housing has said first and second charging terminals therein, an opening through which said charging terminals can be accessed, and a member movable between first and second positions in which said member respectively permits and obstructs access to said charging terminals through said opening.

14. The hearing aid according to claim 12, wherein said housing has first and second openings that extend through a wall thereof, said first and second charging terminals each being disposed within said housing adjacent a separate one of said first and second openings that extend through said housing.

15. A hearing aid adapted to be worn on the human body, said hearing aid comprising:

a microphone, said microphone being configured to generate a microphone signal in response to sound monitored thereby;

an amplifier, said amplifier being connected to said microphone for receiving said microphone signal and being configured to amplify said microphone signal to produce a drive signal;

a power supply disposed in a housing, said power supply including at least one capacitor connected to said amplifier for supplying an energization voltage to said amplifier and a recharging head connected across said at least one capacitor, said recharging head being configured to receive a charging current from a source spaced from said housing and to apply said charging current to said at least one capacitor so as to charge said at least one capacitor; and a speaker connected to receive said drive signal, said speaker being configured to generate audible sounds in response to said drive signal.

16. The hearing aid of claim 15, wherein said recharging head includes at least two terminals adapted for releasably connecting a power supply thereto and said housing is formed with openings in which said recharging head terminals are seated.

17. The hearing aid of claim 16, wherein said housing is formed with a recess, said recharging head terminals are positioned in said housing recess and said housing is provided with a cover for selectively encasing said recharging head housing recess and terminals.

18. The hearing aid of claim 15, wherein said recharging head includes a coil disposed in said housing configured to develop a current therethrough in response to the exposure of said coil to an external electromagnetic field and a processing circuit connected between said coil and said at least one capacitor for applying said charge developed across said coil to said at least one capacitor.

19. A hearing aid adapted to be worn on the human body, said hearing aid comprising:

a housing;

a transducer seated in said housing, said transducer being configured to produce an output signal in response to receiving audible sound;

an amplifier seated in said housing, said amplifier connected to said transducer for receiving said output signal, and being configured to amplify said transducer output signal to produce a drive signal;

a power supply disposed in said housing, said power supply including at least one capacitor seated in said housing, said capacitor being connected to said amplifier for supplying an energization voltage to said amplifier, and a coil connected across said at least one capacitor, said coil being configured to produce an energization current for charging said at least one capacitor when said coil is exposed to an electromagnetic field that originates outside of said housing; and a transmitter mounted to said housing, said transmitter connected to said amplifier for receiving said drive signal and being configured to broadcast sound in response to said drive signal.

* * * * *